United States Patent [19]

Bennett et al.

[11] 4,085,014

[45] Apr. 18, 1978

[54] ELIMINATION OF IMPURITIES FROM SEA WATER CELL FEED TO PREVENT ANODE DEPOSITS

[75] Inventors: John E. Bennett, Painesville; Joseph E. Elliott, Madison, both of Ohio

[73] Assignee: Diamond Shamrock Corporation, Cleveland, Ohio

[21] Appl. No.: 789,669

[22] Filed: Apr. 21, 1977

[51] Int. Cl.[2] ..... C25B 1/26

[52] U.S. Cl. ..... 204/95

[58] Field of Search ..... 204/98, 128, 95

[56] References Cited

U.S. PATENT DOCUMENTS

| | | | |
|---|---|---|---|
| 1,330,738 | 2/1920 | Ellis et al. | 423/605 |
| 1,386,244 | 8/1921 | Dow | 204/98 |
| 3,712,940 | 1/1973 | Silby | 423/140 |

OTHER PUBLICATIONS

"Electrochem. Engineering", by C. L. Mantell, 4th Ed., 1960, pp. 278–279.

*Primary Examiner*—R. L. Andrews

*Attorney, Agent, or Firm*—John P. Hazzard

[57] ABSTRACT

Electrolysis of impure saline solutions containing dissolved iron and manganese causes deposits to form on the anodes of such electrolysis cell which rapidly reduces the efficiency of the cell. Pretreating the impure saline solutions with sodium hypochlorite solution formed from the reaction products of the electrolysis cell precipitates the iron and manganese dissolved therein and effectively prevents the formation of the deleterious deposits on the anode of said electrolytic cell.

4 Claims, No Drawings

ELIMINATION OF IMPURITIES FROM SEA WATER CELL FEED TO PREVENT ANODE DEPOSITS

BACKGROUND OF THE INVENTION

It is common practice to add chemicals to sewage in order to disinfect same prior to discharge thereof into the surrounding watershed. Recently, considerable attention has been directed to the on-site generation of such disinfecting materials, especially sodium hypochlorite, in electrolysis cells. Such on-site production is desirable owing to the problems and expense involved in shipping and storing dilute hypochlorite solutions and the danger in handling the more concentrated chlorine gas in urban areas. Such processes are particularly attractive in coastal locations where the salt values of sea water provide an economical source of the hypochlorite precursor, sodium chloride. Inland, electrolytes may be prepared from solid sodium chloride, whether pure or impure.

The electrolysis of sea, brackish, or impure salt water leads to a pronounced problem, however, in the nature of the formation of heavy deposits on the electrode surfaces. It has been recognized, that calcium and magnesium impurities in the impure saline solutions can cause hardness deposits to build up on the cathode which leads to pronounced increases in operating cell voltages and ultimately these build up to such a thickness as to impede or prevent electrolyte flow. It has now been found that manganese dissolved in the impure brine solution causes an anodic deposit to form which likewise increases the operating cell voltage and lowers operating current efficiency. Normally, manganese is not present in sea water at the concentrations at which it causes such electrolysis problems. However, water from harbors in industrial areas often contain much higher concentrations of manganese because of pollution by the steel and other industries or by ground water which is high in manganese content. Typically, ocean water contains from 0.001 to 0.01 parts per million manganese. The manganese existing in ocean water if mainly in the form of $Mn^{++}$ or $MnSO_4$. It has been found that the threshold concentration for adverse effects due to dissolved manganese in the electrolyte in cell performance is in the range of 0.01 to 0.02 parts per million. Thus, it is apparent that normal concentration of manganese and sea water are not particularly troublesome. However, as mentioned before, waters from industrialized harbor areas often contain higher concentrations of manganese. Typically, Jamaica Bay, New York contain 0.05–0.2 ppm manganese whereas Osaka City and Tokyo Bay in Japan contain 1–4 ppm and 0.05–0.1 ppm manganese respectively.

Dissolved iron which is normally in the form of $Fe(OH)_3$ also causes deposits to form on the anode. However, these deposits are generally not deleterious to cell operation although they do discolor and interfere slightly with visual observation.

Chemically speaking, it is known to remove iron and manganese from water supplies by oxidizing these cations with air, chlorine, potassium permanganate, chlorite ion, ozone, and the like. However, as far as applicants' are aware, such oxidization of iron and manganese to prevent anodic deposits being formed thereby in an electrolysis cell using impure saline solution as the electrolyte was unknown prior to the instant invention.

BRIEF SUMMARY OF INVENTION

The electrolysis of saline solution produces chlorine gas and caustic. These electrolysis products then react or can be caused to react to form a sodium hypochlorite solution. The present invention calls for a recycle of a portion of such hypochlorite solution to treat impure saline solution being fed to the electrolytic cell. In order to require the practice of the instant invention, the impure saline solution which is to be used as the electrolyte must contain dissolved manganese in excess of the concentrations normally found in sea water; and in any event, must exceed the threshold concentration for adverse effects on cell performance which is in the range of 0.01–0.02 ppm manganese. The instant invention therefore contemplates the recycle of a portion of at least a portion of the sodium hypochlorite formed by the reaction of the electrolysis products chlorine and sodium hydroxide to the feed stream of saline solution being fed to the electrolytic cell. The amount or concentration of sodium hypochlorite recycled is dependent on the manganese and iron impurity levels in the impure saline solution. In any event, the hypochlorite concentration should be such that it is at least stoichiometric so as to react and precipitate all of the manganese and iron dissolved in the impure saline solution. The sodium hypochlorite solution must be adequately mixed with the incoming impure saline solution and allowed sufficient contact time so that the precipitation of the iron and manganese can be completed prior to entry of the saline solution into the electrolytic cell. Sufficient contact time has been found to be approximately 3 minutes at stoichiometric concentration levels. However, by increasing the amount of sodium hypochlorite solution recycled, the contact time can be reduced significantly.

DETAILED DESCRIPTION OF THE INVENTION

On site generation of sodium hypochlorite is becoming ever more popular since the electrolysis of saline solutions to produce sodium hypochlorite has become much more trouble-free and more economic. On site hypochlorite generation also avoids costly transportation of dilute hypochlorite solutions and also avoids the dangers inherent in chlorine gas.

Due to the development of the dimensionally stable electrodes, continuous operation of a hypochlorite generation cell with minimal attention has become more of a reality. However, impurities normally found in saline solutions have precipitated in the electrolytic cell and form interfering deposits on the electrodes. Generally, such deposits would occur on the cathode or cathodes of the electrolytic cell and would be caused by impurities such as calcium and magnesium. Such build-ups would gradually affect a loss in current efficiency and ultimately would grow to the extent that they would block electrolyte flow through the cell. Such build-ups on the cathode have been handled in various ways. For example, cathodes have been made extremely smooth so that they resist the deposits adhering firmly thereto. Also electrolyte flow has been speedied up past the cathodes so as to help in sweeping the cathode surface of deposits. Cathode deposits have also been acid washed to remove same and other successful control measures which have been used in the past.

It has been discovered that there is also a problem with anodic deposits caused by impurities in the fed saline solution. Such anodic deposits are caused by the precipitation of dissolved iron and manganese from the saline solution onto the anode in the electrolytic cell. The precipitation of the dissolved iron discolors the cell but does not appear to be damaging to current efficiency. On the other hand, manganese present in excess of 10 ppb in the feed saline solution will precipitate and form an adherent deposit on the anode of the electrolytic cell which will rapidly decrease the current efficiency of the cell.

Normally, sea water or artificially produced saline solution would not have sufficient manganese content to require the use of the instant invention. Sea water usually contains less than 10 ppb manganese and typically the manganese content is in the range of 1–3 ppb manganese. However, in contaminated waters which contain more than about 10 ppb manganese the instant invention is most useful in effecting a continuous electrolysis of the impure saline solution to form hypochlorite. Typically, such impure saline solutions are found in harbor areas near iron and steel production facilities or in areas where ground run-off water contains high manganese content.

The present invention calls for the recycle of sodium hypochlorite containing solution made by the said electrolytic cell and mixing same with the incoming impure saline solution which is to be fed to the electrolytic cell. The amount of hypochlorite recycled of course depends on the concentration of iron and manganese impurities in the impure saline solution being fed to the electrolytic cell. There should be at least a stoichiometric amount of hypochlorite recycled to be capable of precipitating all of the iron and manganese impurity in the feed impure saline solution. When the amount of hypochlorite recycled is approximately stoichiometric with the iron and manganese impurities present, a contact time of approximately 3 minutes will be sufficient to cause the iron and manganese to be oxidized and precipitated prior to entry of such saline solution feed to the electrolytic cell. Thus, precipitation within the cell and on the anode or anodes thereof is effectively prevented.

Preferably, hypochlorite in excess of the stoichiometric amount required to precipitate the iron and manganese impurities is circulated back and mixed with the impure saline solution feed. Such excess hypochlorite recycled can greatly cut down the contact time required to precipitate all of the iron and manganese impurity present. Preferably, a ten fold excess of hypochlorite is recycled although greater or lesser amounts in excess of stoichiometric amounts can be utilized as long as the contact time is suitably adjusted. The hypochlorite used to precipitate the manganese and iron impurities could also come from an independent source other than the said electrolytic cell and such is included within the scope of the present invention. In addition to the precipitation of the manganese and iron impurities by pretreatment with hypochlorite, other precautionary steps may be taken in case a sudden imbalance in the system should occur, as for example a much higer manganese content feed material or the like be suddenly introduced into the system. Such precautionary steps could include one or more of the following—utilize extremely smooth anodes; accelerate the saline solution past the anodes or; utilize a platinum or platinized anode—each of which appears to diminish a rate of build-up of deposits on the anode.

Essentially, the present invention provides a means to convert impure aqueous saline solutions, especially sea water into a solution having microbicidal properties. This is accomplished by the relatively low current density electrolysis of same into a hypochlorite solution which may then be mixed directly with the material to be treated, e.g., the effluent from a municipal waste treatment plant or an industrial cooling stream. Smooth and continuous operation is achieved in such a cell by recycling a portion of the generated hypochlorite solution to be mixed with the incoming impure saline solution being fed to the cell and allowing sufficient contact between the recycled stream and the incoming stream to effectively precipitate all iron and manganese impurities prior to the entry of the combined feed stream into the electrolytic cell thus preventing any deposition on the anode or anodes within the cell.

The electrolytic cell used in the present invention to electrolyze the saline solution contains at least one anode and one cathode. Normally however, there would be an alternating array of preferably vertically disposed anodes and cathodes spaced about 0.20 to 0.5 centimeters apart. The saline solution which has been purified of dissolved iron and manganese impurities by the recycle stream is passed between the electrodes and electrolyzed by a current in the range of from 1.5 to 25 amperes per square decimeter to produce chlorine and sodium hydroxide. A rapid chemical reaction then occurs to produce sodium hypochlorite at a concentration which depends on a variety of factors such as current density, electrolyte flow rate, temperature, and salinity.

By the term "impure saline solution", it is intended to refer to sea water, brackish water, or an aqueous solution prepared from impure salt, all of which contain iron and manganese ions in excess of 10 parts per billion. Generally, the concentration of sodium chloride in the solutions, for economic and practical reasons, will be within the range of 10–35 grams per liter.

The anodes employed are generally flat, and dimensionally stable, i.e., not significantly subject to chemical or mechanical attrition in use. The anode composition is not critical to the present invention as any electrically conductive substrate bearing an electrocatalytically active coating on the surface thereof will generally suffice. Typical is titanium metal coated with a titanium dioxide-ruthenium dioxide solid solution. While sheet or continuous anodes are satisfactory, superior results will be obtained if foraminous anodes are employed. This serves to increase inner electrode turbulence without detracting from uniformity of velocity, thereby further reducing anodic deposits.

The cathodes employed are preferably flat, in the sense of lying in one level plain, and continuous (not perforated or segmented). Preferably, the leading and terminal, i.e., vertical edges, are smooth and rounded rather than being angular. While it is generally stated that the smoother the surface of both anode and cathode, the better the results will be, a maximum roughness of less than $2.54 \times 10^{-4}$ cm. is preferably employed. Such cathodes will be metallic, for reasons including wear resistance, electrical conductivity, and low hydrogen over-voltage. Typical are titanium, nickel and various ferrous and nickel alloys. Especially preferred is Hastalloy C, trademark of Union Carbide Corporation for a nickel alloy. Since the surfaces are metallic, the low roughness values can generally be achieved with conventional metal working techniques such as polishing or the like.

All unstated conditions of operation are conventional and not critical to the invention. For example, a pH within the range of 7.0 to 10 and temperatures of 5°–50° C are typically employed in the electrolytic production of sodium hypochlorite from sodium chloride solutions.

In order that those skilled in the art may more readily understand the present invention in certain preferred embodiments by which it may be carried into effect, the following specific examples are offered.

EXAMPLE 1

A SANILEC sea water cell was set up for operation on New York harbor sea water. SANILEC is a trademark of Diamond Shamrock Chemical and this sea water cell had a capacity for producing 150# per day of available chlorine in the form of sodium hypochlorite solution. The SANILEC cell actually consists of two separate cells each capable of producing 75# per day of available chlorine. Each cell consists of three anodes and two cathodes. The electrodes are arranged parallel to one another and are made of expanded mesh titanium with a dimensionally stable coating. The active electrolytic area was 1250 square inches. The cell was operated at 1 amp per square inch and sea water was fed to the cell at a rate such that the effluent from the cell contained .05% sodium hypochlorite. At startup, the current efficiency of the cell was 76%. The efficiency rapidly declined until it had decreased to 44% current efficiency after a lapse of only 10 days. Examination of the cell showed essentially no hardness build-up on the cathode but considerable iron and manganese build-up on the anode due to the presence of high amounts of manganese in the New York sea water. Analysis at various times shown the manganese content of the New York harbor sea water to range from 50–200 ppb manganese. The operating temperature of the cell was in the range of 17°–18° C and the incoming sea water had a salinity of 69–74%, that of normal ocean water.

Acid washing of the contaminated anode resulted in the recovery of current efficiency for the cell to 82%.

EXAMPLE 2

The SANILEC cell as used in Example 1 was again utilized in this example. The same operating conditions were likewise utilized with the exception that the fed saline solution had varying quantities of dissolved manganese. In this case, the saline solution approached 100% of normal ocean salinity. In the first run, utilizing a saline solution feed containing less than 10 ppb manganese, the cell efficiency fell from an initial current efficiency of 86% to 83% after 25 days of continuous operation. A second run utilizing a saline feed solution containing 14 ppb manganese resulted in a current efficiency drop from an initial 86% to 73% after 25 days continuous operation. In a third run using a 35 ppb manganese impurity level, the current efficiency dropped from an initial 91% to 53% after only 15 days whereupon the run was discontinued. In a fourth run using a saline solution impregnated with 79 ppb manganese, current efficiency of the cell dropped from an initial 86% to 40% after only 9 days on line. Thereafter this run was discontinued.

EXAMPLE 3

The runs mentioned in Example 2 above were again repeated with the exception that the saline solution being fed to the SANILEC cell was of the same makeup, but contained less than 10 parts per billion manganese and less than 10 parts per billion iron. A contact time of from 2 to 3 minutes is sufficient to precipitate all of the manganese and iron from the feed saline solution. In every case, the cell was operated on such purified feed material for 40 days without any substantial reduction in current efficiency of the cell.

In the foregoing examples and as discussed in the specification, the manganese and iron impurities found in the sea water or other impure saline solutions is oxidized by the available chlorine so that it is precipitated as $MnO_2$ and $Fe(OH)_3$. Preferably, the precipitated impurities are filtered from the feed stream prior to introduction of same to the electrolytic cell.

What is claimed is:

1. A method for eliminating the formation of manganese impurity caused anode deposits upon the electrolysis of aqueous saline solutions contaminated with manganese, which method comprises contacting said impure aqueous saline solution feed with sufficient sodium hypochlorite solution recycled from the electrolytic cell for a time sufficient to precipitate the manganese present to reduce the dissolved manganese content therein to a level less than about 10 parts per billion by weight manganese and feeding said saline solution now purified with respect to manganese impurities to said electrolytic cell and electrolyzing said saline solution between at least one anode and at least one cathode in said electrolytic cell.

2. A method for eliminating the formation of manganese impurity caused anode deposits and iron impurity caused deposits upon the electrolysis of aqueous saline solutions contaminated with manganese and iron, which method comprises contacting said impure aqueous saline solution feed with sufficient sodium hypochlorite solution recycled from the electrolytic cell for a time sufficient to precipitate the manganese and iron present to reduce the dissolved manganese content therein and the dissolved iron content therein to levels less that about 10 parts per billion by weight manganese and 10 parts per billion by weight iron and feeding said saline solution now purified with respect to manganese and iron impurities to said electrolytic cell and electrolyzing said saline solution between at least one anode and at least one cathode in said electrolytic cell.

3. A method for eliminating the formation of manganese impurity caused anode deposits upon the electrolysis of aqueous saline solutions contaminated with manganese, which method comprises contacting said impure aqueous saline solution feed with sodium hypochlorite solution recycled from the electrolytic cell for approximately three minutes to precipitate the manganese present to reduce the dissolved manganese content therein to a level less than at least less than 10 ppb manganese, said sodium hypochlorite recycle being such that amount of sodium hypochlorite in the combined solutions is approximately 10 parts per billion by weight, and feeding said saline solution now purified with respect to manganese impurities to said electrolytic cell and electrolyzing said saline solution between at least one anode and at least one cathode in said electrolytic cell.

4. A method for eliminating the formation of manganese impurity caused anode deposits and iron impurity caused deposits upon the electrolysis of aqueous saline solutions contaminated with manganese and iron, which method comprises contacting said impure aqueous saline solution feed with sodium hypochlorite solution recycled from the electrolytic cell for approximately three minutes to precipitate the manganese and iron present to reduce the dissolved manganese content therein and the dissolved iron content therein to levels less than about 10 parts per billion by weight manganese and 10 parts per billion by weight iron, said sodium hypochlorite recycle being such that amount of sodium hypochlorite in the combined solutions is approximately 10 parts per million by weight, and feeding said saline solution now purified with respect to manganese and iron impurities to said electrolytic cell and electrolyzing said saline solution between at least one anode and at least one cathode in said electrolytic cell.

* * * * *